United States Patent [19]

Karassik et al.

[11] 4,037,985

[45] July 26, 1977

[54] FLUSHING LIQUID SYSTEM FOR THE WEARING RING IN CENTRIFUGAL PUMPS AND THE WEARING RING ASSEMBLY AND WEARING RING FOR USE THEREIN

[75] Inventors: Igor J. Karassik, Maplewood; Charles H. Thaw, Morristown, both of N.J.

[73] Assignee: Worthington Pump, Inc., Moutainside, N.J.

[21] Appl. No.: 688,156

[22] Filed: May 20, 1976

[51] Int. Cl.[2] ..... F01D 11/00; F04D 29/08; F01D 11/08

[52] U.S. Cl. ..... 415/175; 415/169 A; 415/170 A; 277/15

[58] Field of Search ..... 415/175, 174, 171, 112, 415/169 A, 170 A, 170 B; 277/15, 75, DIG. 8

[56] References Cited

U.S. PATENT DOCUMENTS

| | | | |
|---|---|---|---|
| 811,642 | 2/1906 | Key | 415/175 X |
| 953,627 | 3/1910 | Leighton | 277/15 |
| 1,770,496 | 7/1930 | Lawaczeck | 415/169 A X |
| 1,999,163 | 4/1935 | Allen | 415/175 X |
| 2,021,346 | 11/1935 | Allen | 415/170 A UX |
| 2,736,265 | 2/1956 | Higgins | 415/171 |
| 3,484,113 | 12/1969 | Moore | 277/75 X |
| 3,622,164 | 11/1971 | Herbert | 415/169 A X |

FOREIGN PATENT DOCUMENTS

| | | | |
|---|---|---|---|
| 35,965 | 1/1909 | Austria | 415/169 A |
| 944,786 | 4/1974 | Canada | 277/DIG. 8 |
| 284,580 | 4/1931 | Italy | 277/75 |

*Primary Examiner*—Carlton R. Croyle
*Assistant Examiner*—Donald S. Holland
*Attorney, Agent, or Firm*—Daniel H. Bobis

[57] ABSTRACT

A flushing liquid system for an improved wearing ring in a centrifugal pump which wearing ring has spaced flushing liquid inlet and outlet chambers, has a first control assembly for supplying flushing liquid to the flushing liquid inlet chamber and a second control assembly for returning or draining at least a portion of the flushing liquid through the flushing liquid outlet chamber, with respective first and second control assemblies either having a predetermined setting or operatively responsive to signals from sensory devices for sensing at least one or more operating conditions of the centrifugal pump so that the operation of the first and second control devices can act to minimize flushing liquid requirements of the wearing ring and minimize dilution by the flushing liquid of the process fluid or mixture being pumped by the centrifugal pump.

Additionally, the improved wearing ring for use in said flushing liquid system having a first groove on the outer surface thereof operative to form the flushing liquid inlet chamber connected to the source of flushing liquid, a second groove on the outer surface of the wearing ring disposed a spaced distance from said first groove operative to provide the flushing liquid outlet chamber, a plurality of first and second passages to communicate the respective first groove and second groove with the leakage joint formed by said wearing ring with the impeller for said centrifugal pump, said first groove and second groove operative to permit at least a portion of the flushing liquid delivered from said first groove to be returned or drained through the second groove.

Additionally, means formed in the leakage joint between the improved wearing ring and the impeller of the centrifugal pump to resist axial flow of the process fluid being pumped by the centrifugal pump into the leakage joint from either direction.

11 Claims, 9 Drawing Figures

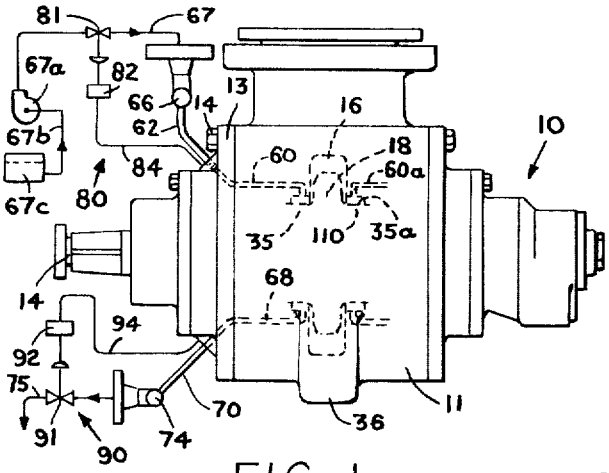
FIG. 1
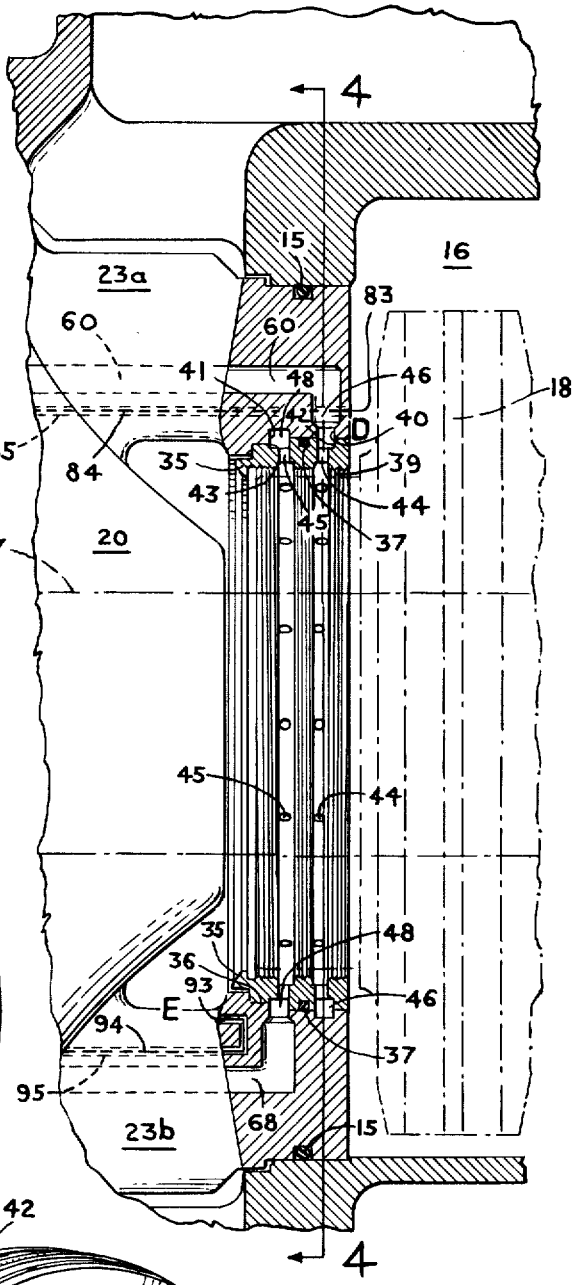
FIG. 3
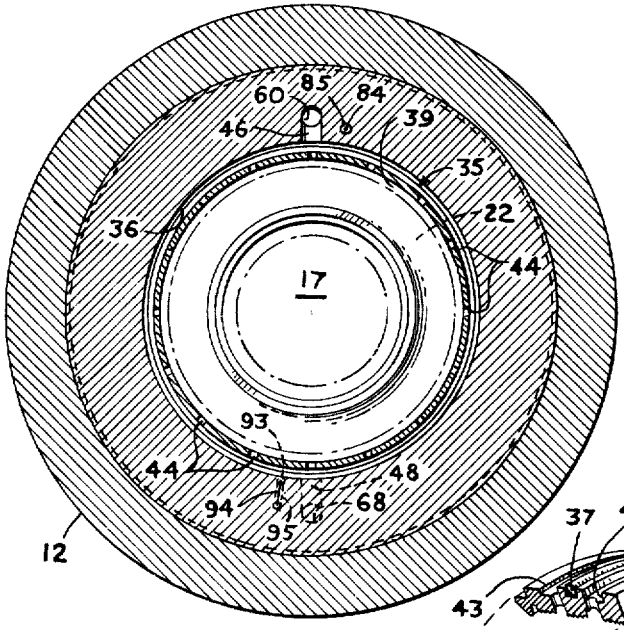
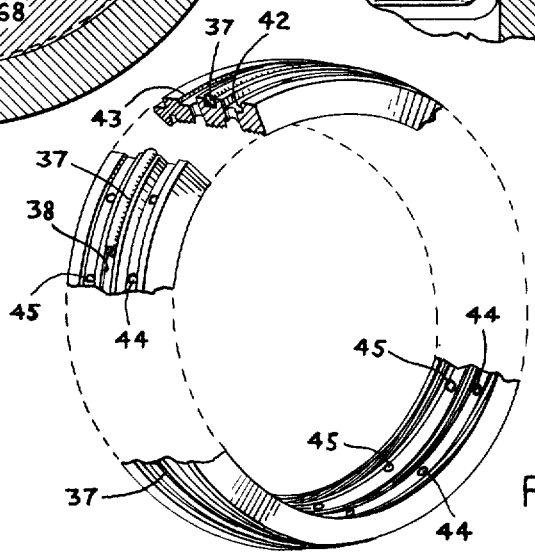
FIG. 4
FIG. 5

FLUSHING LIQUID SOURCE
DRAIN

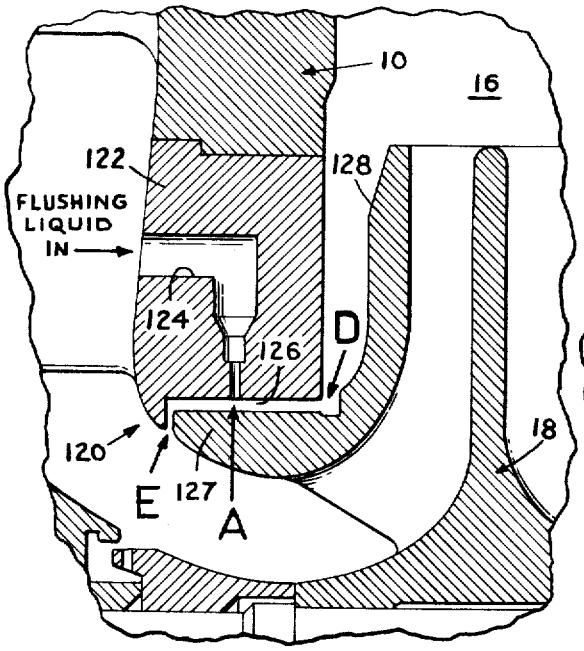

PRIOR ART — WEARING RING WITH CONVENTIONAL FLUSHING.

FIG. 6

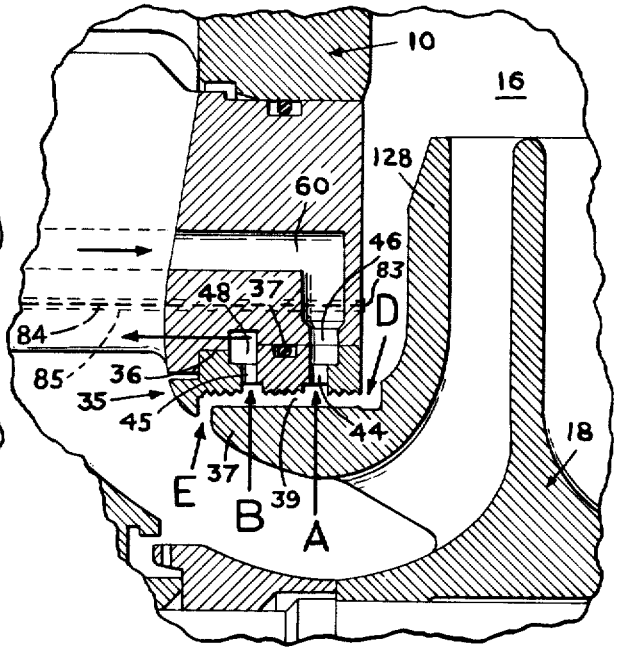

IMPROVED WEARING RING AND SYSTEM FOR REDUCED DILUTION.

FIG. 7

| COMPARISON TABLE | | |
|---|---|---|
| | FIG. 6 | FIG. 7 |
| TOTAL PUMP FLOW, Q IN GPM | 5,000 | 5,000 |
| $P_1$, SUCTION PRESSURE AT "E" IN PSIG | 100 | 100 |
| $P_2$, DISCHARGE PRESSURE, IN PSIG | 600 | 600 |
| $P_3$, PRESSURE AT "D" IN PSIG | 450 | 450 |
| INJECTION PRESSURE, IN PSIG | 700 | 500 |
| $\Delta P$ (D TO E) = $P_3 - P_1$ IN PSIG | — | — |
| $\Delta P$ (A TO D) IN PSI | 250 | 50 |
| $\Delta P$ (A TO E) IN PSI | 600 | — |
| $\Delta P$ (A TO B) IN PSI | — | 350 |
| $\Delta P$ (B TO E) IN PSI | — | 50 |
| $q_1$ IN GPM (INJECTION FLOW TO A) | 215 | 137.5 |
| $q_2$ IN GPM (A TO D) | 85 | 37.5 |
| $q_3$ IN GPM (A TO E IN FIG. 6 & B TO E IN FIG. 7) | 130 | 37.5 |
| $q_4$ IN GPM (B TO DRAIN) | — | 62.5 |
| TOTAL DILUTION = $q_2 + q_3$ IN GPM | 215 | 75 |
| DILUTION IN % OF PUMP FLOW | 4.3 | 1.5 |

FIG. 8

FLUSHING LIQUID SYSTEM FOR THE WEARING RING IN CENTRIFUGAL PUMPS AND THE WEARING RING ASSEMBLY AND WEARING RING FOR USE THEREIN

BACKGROUND OF THE INVENTION

This invention relates to a flushing liquid system for the wearing ring in a centrifugal pump which is particularly adaptable for use in the pumping of slurries in applications wherein excessive dilution of the latter cannot be tolerated, and to an improved wearing ring for use in said system.

Although liquid flushed wearing rings for use in centrifugal pumps are well known in the prior art as exemplified by U.S. Pat. No. 2,736,265 to Higgins, there are pumping applications in which the same do not prove particularly satisfactory in that excessive dilution of the liquid being pumped can result from the effect of the wearing ring flushing liquid.

For example in a pumping application for slurry, in order to prevent abrasion and rapid wear of the liquid flushed wearing ring in the centrifugal pump by the solids in the slurry, the percentage of solids in the slurry mixture will be optimized so as to in turn minimize friction losses and reduce excessive power expenditures.

This optimum percentage of solids to liquid in the slurry mixture can be very critical so that even small increases or decreases of solids to liquid in the slurry mixture will cause substantial increases in friction. Use of a prior art flushing liquid system for the wearing ring can under these conditions result in excessive and unacceptable dilution of the slurry.

Further, in those instances wherein the slurry mixture is prepared by the mixing of solid particles in a transporting liquid, the transporting liquid in essence becomes a necessary evil, and the pumping of any extra quantity of the transporting liquid beyond the minimum which renders the slurry mixture economically pumpable—as results from excessive dilution by the use of such prior art liquid flushed wearing ring—will result in an increase in the consumption of pumping energy for pumping the same.

In addition, many of the flushing liquid systems for wearing rings in the prior art do not include means for throttling the flushing liquid inlet flow and must accordingly operate at inordinately high flushing liquid inlet flow rates in order to insure that there will be sufficient flushing liquid to meet the requirements of the wearing ring throughout the entire operating range of the pump.

Further, in those locations where there is a scarcity of clear liquid for use in flushing the wearing ring, and/or dirty or contaminated liquids must be treated for use as flushing liquid, other functional and/or economic disadvantages are presented.

The present invention seeks to overcome these problems of the prior art by providing an improved flushing liquid system for the wearing ring of the centrifugal pumps and an improved wearing ring for use with the system which will act to optimize and minimize the flushing liquid required for the wearing ring and provide the additional advantage of minimizing dilution of the process fluid, slurry or other mixture being pumped by the associated centrifugal pump to which the improved wearing ring and flushing system is applied.

SUMMARY OF THE INVENTION

Thus the present invention covers a flushing liquid system for the wearing ring in a centrifugal pump which comprises, an annular wearing ring having flushing liquid inlet and outlet chambers, flushing liquid supply means connected to the inlet chamber to supply flushing liquid to the wearing ring, and flushing liquid return means connected to the outlet chamber for returning or draining off at least a portion of the flushing liquid delivered to the wearing ring, and a first control means is provided for controlling the delivery of flushing liquid to the flushing liquid inlet for the wearing ring, a second control means is provided for controlling the return or draining off of at least the said portion of the flushing liquid through the flushing liquid outlet chamber, and suitable means including, at least one sensing means responsive to an operating condition of the pump is connected to at least one of the control means to signal said operating condition thereto for controlling the delivery and return of flushing liquid from the wearing ring so as to minimize the quantity of flushing liquid required by the wearing ring and to reduce dilution by flushing liquid of the process fluid or mixture being pumped by the centrifugal pump.

Additionally, the present invention covers the improved wearing ring for use in said flushing liquid system wherein the wearing ring includes an annular member, a first annular groove on the outer periphery of said annular member operative to form a flushing liquid inlet and a second annular groove on the outer periphery of the annular member spaced from said first annular groove operative to form the flushing liquid outlet chamber, a first and second passage means disposed to connect with the respective first and second annular grooves to provide communication of said first and second annular groove with the leakage joint formed by the wearing ring and the impeller of the centrifugal pump and to permit at least a portion of the flushing liquid delivered to the flushing liquid inlet chamber to pass to the flushing liquid outlet chamber, and sealing means on the outer periphery of the wearing ring to provide a fluid tight connection thereof in assembled position in the pump for separating said flushing liquid inlet chamber from the flushing liquid outlet chamber.

Additionally, means providing spaced spiralled surfaces at the leakage joint between the wearing ring and the impeller each having a predetermined turning direction to resist the tendency of the process fluid or mixture being pumped by the centrifugal pump to flow into the leakage joint.

OBJECTS OF THE INVENTION

Accordingly, it is an object of the present invention to provide a flushing liquid system for the wearing ring in a centrifugal pump which reduces the amount of flushing liquid required to effect satisfactory flushing of the wearing ring.

It is another object of this invention to provide a flushing liquid system for the wearing ring in a centrifugal pump which operates to minimize dilution of the liquid being pumped by the flushing liquid.

Another object of the present invention is to provide a flushing liquid system for wearing rings adaptable for use in a wide variety of centrifugal pumps, and which requires the use of readily available control and sensing components of proven dependability to provide for long periods of satisfactory maintenance free operation.

A further object of the invention is the provision of an improved wearing ring for use in the flushing system for wearing rings in accordance with the present invention.

Other objects and advantages of this invention will be clear from the following detailed description thereof taken in conjunction with the accompanying drawings wherein:

FIG. 1 is a side elevational view of a double suction centrifugal pump incorporating the flushing liquid system for wearing rings in centrifugal pumps in accordance with the present invention.

FIG. 3 is an enlarged view of a portion of FIG. 2 with the pump impeller shown in phantom form.

FIG. 4 is a cross-sectional view taken along line 4—4 in FIG. 3.

FIG. 5 is a perspective view of a wearing ring of the invention with a portion broken away.

FIG. 6 is an enlarged cross-sectional view taken through a portion of a centrifugal pump which incorporates a liquid flushed wearing ring in accordance with the prior art.

FIG. 7 is an enlarged cross-sectional view taken through a portion of a centrifugal pump which incorporates a liquid flushed wearing ring in accordance with the present invention; and FIG. 8 is a table which sets forth for ready comparison the essential performance characterisics of the liquid flushed wearing rings of FIGS. 6 and 7.

DESCRIPTION OF THE PREFERRED EMBODIMENT

Figures 2, 9:
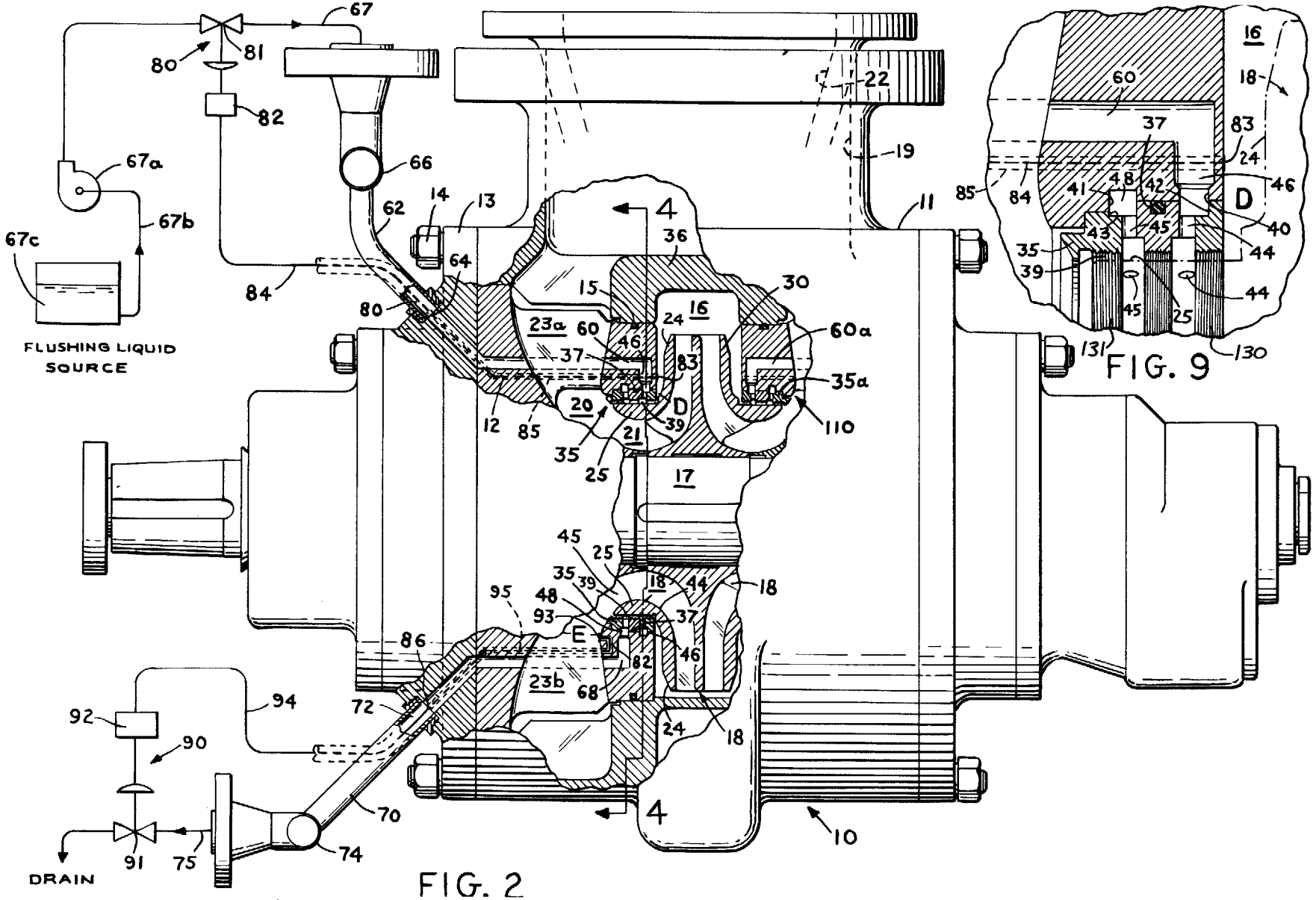
FIG. 2 is a side elevational view of the pump of FIG. 1 with parts broken away and parts in vertical section.
FIG. 9 is an enlarged view of one form of special configuration in the leakage joint between the wearing ring and the impeler of the centrifugal pump.

Referring to FIGS. 1, 2 and 3 of the drawings a single stage double suction centrifugal pump generally designated 10 is illustrated. Pumps of this nature are believed well known to those skilled in the art to be particularly effective for the pumping of slurry mixtures consisting of liquids and solids.

While a double suction centrifugal pump is illustrated and therefore requires a double flushing liquid system for the wearing ring assemblies it will be understood that only one of the systems and wearing ring assemblies will be illustrated and described for the purpose of illustrating the present invention.

Thus, the centrifugal pump 10 is shown as having, a central pump casing member 11, an annular casing member 12, and a cover member 13, which are held in engagement by means of the threaded members 14.

An O-ring means 15 forms a fluid tight joint between the central pump casing member 11 and the annular casing member 12.

The central pump casing member 11 defines a pumping chamber 16 and a driven shaft 17 rotatably mounted in the pump 10 extends through the central pump casing 11 into the pumping chamber 16 where a double suction impeller 18 disposed in the pump chamber is fixedly mounted on the driven shaft 17 and rotatable therewith.

The inlet 19 for the pump 10 is connected to the slurry mixture to be pumped and an inlet flow passage 20 formed in the annular casing member 12 communicates at one end with the inlet 19 and with the end remote therefrom with one of the suction eyes 21 of the double suction impeller 18.

The double suction impeller 18 discharges into the pumping chamber 16 which in turn communicates with the discharge outlet 22 for the pump 10.

The intermediate annular casing member is further shown as having transverse struts or vanes 23*a*, and 23*b* extending as at circumferentially spaced positions across the inlet flow passage 20 all of which is clearly shown in FIGS. 2, 3 and 4 of the drawings.

Since pumps of this type are well known in the art, it is not deemed necessary to describe the further structure and operation of these pumps as the present invention is applicable to any type of centrifugal pump adapted for pumping mixtures which require that the wearing ring therein be supplied with flushing liquid.

Referring to FIGS. 2 and 3, the double suction impeller 18 is shown as having a front shroud 24 which has an axially extended portion 25 about the suction eye 21 of the impeller in communication with the inlet flow passage.

Those skilled in the art will understand that in order to maintain efficient operation of centrifugal pumps of this type that the front shroud must be operatively associated with a suitable wearing ring and further that a flushing liquid system generally water must be provided to prevent abrasion and excessive wear between the wearing ring and the impeller.

The present invention is particularly directed to an improved wearing ring and a flushing liquid system for use therewith which is particularly designed and adapted to accomplish this result as will now be described.

WEARING RING ASSEMBLY AND WEARING RING

Thus referring to FIGS. 2, 3, 4 and 5 of the drawings, the improved wearing ring assembly generally indicated at 30 for use in the flushing liquid system in accordance with the teachings of this invention has a wearing ring 35 having an annular shape and size to permit the wearing ring to be removably mounted in an appropriately grooved annular opening 36 in the intermediate annular casing member 12. The wearing ring 35 is maintained in assembled position in any suitable manner to permit the convenient removal and replacement thereof either for periodic maintenance or in the event of failure of the seal or leakage joint formed with the impeller 18 for any reason.

an O-ring 37 disposed in an annular groove 38 on the outer surface of the wearing ring 35 will provide a fluid tight seal between the outer surface of the wearing ring 35 and the inner surface of the annular opening 36.

FIGS. 2, 3, 4 and 5 further show that the wearing ring 35 extends radially inward into reasonably close proximity with the adjacent annular surface of the extended portion 25 of the front shroud 24 on the impeller 18 to form a leakage joint or interface 39 therewith which is swept or maintained as free of abrasive material as possible by the flushing water system in accordance with the present invention. Spaced annular grooves 40 and 41 formed in the inner surface of the annular opening 36 of casing member 12 which annular grooves 40 and 41 will mate when the wearing ring 35 is in assembled position with complimentary spaced annular grooves 42 and 43 formed in the outer surface of wearing ring 35 so that they form therewith an annular flushing inlet chamber 46 and an annular flushing liquid outlet chamber 48 which are respectively disposed in spaced relation to each other on opposite sides of the O-ring 35 and are thus sealed from communication with each other at the outer surface of the wearing ring 35.

A plurality of circumferentially spaced flushing liquid inlet apertures 44 provides communication between chamber 46 and the inner surface of wearing ring 35 while a like plurality of circumferentially spaced flushing liquid outlet apertures 45 provides communicating from said inner surface of wearing ring 35 with the flushing liquid outlet chamber 48.

In order to deliver flushing liquid to the flushing liquid inlet chamber 46 a flushing liquid inlet conduit indicated generally at 60 is formed by a plurality of aligned bores which extend respectively through the cover member 13, the strut or vane 23a of the annular intermediate casing 12, and central casing 11 so that the end of the flushing liquid inlet conduit 60 in the central casing 12 communicates with the flushing liquid inlet chamber 46. At the opposite end where the flushing liquid inlet conduit 60 opens on the cover member 13, it is connected to a flushing liquid supply or delivery line 62 as at 64.

An annular flushing liquid inlet manifold 66 communicates with the flushing liquid supply or delivery line 62 and flushing liquid is supplied to the flushing liquid manifold 66 by a connecting line 67 connected at one end to the manifold 66 and at the opposite end to a pump 67a which in turn takes its suction through line 67b from the reservoir 67c which contains the source of flushing liquid.

A suitable control means generally designated 80 is connected in the line 67 and will control the flow of flushing liquid through line 67 to the annular flushing liquid manifold 66 as is more fully described hereinafter.

The annular flushing liquid inlet manifold 66 is necessary to provide a common means for supplying the respective flushing liquid inlet conduits required for the respective wearing rings on both sides of the impeller 18 as is indicated by the wearing ring **35*a* and flushing liquid inlet conduit 60a in FIG. 1** and of the drawings.

FIGS. 1, 2, 3 and 4 also show that there is a coacting system for draining or removing at least a portion of the flushing liquid which passes through the leakage joint in a direction towards the suction inlet flow passage 20 for pump 10. This flushing liquid passes from the flushing liquid outlet chamber 48 through a flushing liquid outlet conduit 68 formed by a plurality of aligned bores which respectively extend through the cover member 13, the strut or vane **23*b* in the annular intermediate casing 12 and central casing 11 where the inner end of the flushing liquid outlet conduit 68 communicates with the flushing liquid outlet chamber 48**.

As with the flushing liquid inlet conduit 60, the flushing liquid outlet conduit 68 connects at the point where it opens on the exterior of the cover member 13 with a flushing liquid return line 70 as at 72.

An annular flushing liquid return manifold at 74 communicates with the return line 70 and in turn passes the flushing liquid to the drain line 75 which is either connected to a waste disposal point or to a suitable filter clarification and neutralizing system (not shown) for rehabilitating the flushing liquid before it is returned to the flushing liquid reservoir **67*c***.

The ecological advantages of providing a closed system which preserves the flushing liquid, generally water, will be understood by those skilled in the art. Further, where the flushing liquid is other than water, it will be clear that it is imperative to reduce any loss of flushing liquid as this will reduce the overall cost of operating the pump.

As in the case of the flushing liquid supply system, the flushing liquid return or drain system is also provided with a flushing liquid return control system or means generally designated 90 which is also described hereinafter.

To regulate and control the delivery and draining or return of flushing liquid to and from the wearing ring assembly, coacting control arrangements for delivery of the flushing liquid and for draining or returning the flushing liquid must be provided.

Any of a plurality of systems can be established for this purpose wherein the control of the delivery of flushing liquid and control of the return or drain of flushing liquid are each responsive to an operating parameter of the pump. Alternatively, either the control of the delivery or the control of the return or drain of flushing liquid can be given a predetermined fixed setting while the other is varied responsive to an operating condition. Such variations of the control system as herein illustrated are within the ability of and will be understood by those skilled in the art.

In any system selected however there will be a differential between either the respective selected operating parameters or between the predetermined setting and the selected operating parameter which will serve to adjustably minimize the flushing water requirements of the associated wearing ring which in turn will minimize dilution by the flushing liquid of the process liquid or mixture being pumped.

In the preferred form of the invention illustrated now to be described the difference between two operating parameters is utilized to obtain the desired operational result for a flushing liquid system for wearing rings in accordance with the present invention.

FLUSHING LIQUID CONTROL SYSTEM

FIGS. 1, 2, 3 and 4 show that the control arrangement 80 for regulating the pressure and volume of flushing liquid delivered to the flushing liquid inlet chamber 46 includes, a control valve 81 in line 67 such as a diaphragm motor type throttling valve which can be adjusted from the normally closed position to the full open position thereof by any suitable positioning means 82 when suitable signals are delivered to the positioning means as is hereinafter described.

Control valves and positioners of this type are well known and can be easily purchased on the open market. For example, the 7000 Series pneumatic positioners manufactured and sold by Masoneilan International Inc. will provide an exact linear relationship of the sensing signal to the valve positioner which latter element can be adjusted proportionally so as to exceed the selected operating parameter being sensed by a predetermined amount to provide the advantageous results of optimizing the flushing water required for maintaining the wearing ring and at the same time minimizing dilution of the slurry or other mixture being pumped. These elements of the control arrangement being so well known as to structure and operation have been illustrated only in schematic form as it is believed their inclusion into the overall system will be readily understood by those skilled in the art.

It will be further understood by those skilled in the art that while the illustrated type of control valve 81 and the example of the same available on the open market are pneumatically operated which type is preferred for the flushing liquid system in accordance with the present invention that such control valve and positioner can be of the hydraulic type, electro-hydraulic; or electric without departing from the scope of the present invention.

In the case of control arrangement 80, the injection pressure and volume of flushing liquid delivered to the flushing water injection chamber 46 is accomplished by signals to the positioner 82 by means of a suitable first pressure sensing element 83 disposed in the discharge outlet 16 at the area or point therein designated D. The sensing element 83 may be any conventional type of sensing device for sensing the operating parameter for controlling the control valve 81 such as the pressure at point D in the discharge outlet 16.

The pressure sensing element 83 is connected to the positioner means 82 by means of a connecting line or conduit 84 which passes to the exterior of pump 10 through suitable aligned bores 85 in the supporting strut or vane 23a in the annular intermediate casing 12 and the cover member 13 as is shown in FIGS. 1 and 2 of the drawings.

Similarly in the case of the control arrangement 90 for regulating the pressure and volume of flushing liquid returned or drained from the flushing liquid outlet chamber 48, FIGS. 1, 2, 3 and 4 show that this control arrangement is provided with a control valve 91 in the drain or return line 75, which control valve 91 is adjustable from normally closed to full open position by a positioning means generally designated 92.

As in the control means for the delivery of flushing liquid, the control valve 91 and positioning means 92 are only schematically illustrated because such valves are well known to those skilled in the art and are easily purchasable on the open market.

Pressure in the suction inlet flow passage 20 sensed by a pressure sensing element 93 disposed adjacent the area E in the suction inlet flow passage 20 is transmitted through a suction pressure transmitting line 94 which extends through the pump to the exterior thereof for connection to the positioning means 92. The suction pressure transmitting line 94 will pass through suitable aligned bores 95 in the central casing 11, the support strut or vane 23b in the annular intermediate casing 12, and the cover member 13 to the exterior of the pump as is shown in FIGS. 1 and 3 of the drawings.

Although only one flushing liquid supply conduit 60 and supply line 62 are shown in the illustrated form of the invention, it will be understood that a plurality of circumferentially disposed sets of flushing liquid supply conduits 60 and supply lines 62 may be utilized to connect the supply manifold 66 to the flushing liquid inlet chamber 46 at arcuately spaced points as may be required or desired for a particular type pump. In a like manner although one return conduit 68 and return line 70 are shown in the drawings, it will again be understood that more than one interconnected set of the same may also be utilized to connect the manifold 74 to the outlet chamber 48 as may be required for a given pump utilizing the flushing liquid system and wearing ring assembly in accordance with the present invention.

In a double suction pump it will be readily understood that the operatively associated fluid liquid supply and return control system above described can be duplicated at the wearing ring for the other suction eye of the impeller 18 in the same manner depicted in detail in the FIGURES of the drawings. Such additional wearing ring is designated 35a in FIGS. 1 and 2 of the drawings and by particular reference to FIG. 2 it will be clear that the structure, operation and control of the flushing liquid supply and return system with wearing ring 35a on the opposite suction side of the impeller will be identical with that above described for wearing ring 35.

OPERATION

Whenever shaft 17 of the pump 10 is driven by any suitable driving means (not shown) the impeller 18 mounted therein will also rotate and the slurry or similar mixture to be pumped will enter through inlet 19 and suction inlet flow passage 20 into the suction eye 21 of the impeller 18. The impeller will discharge this slurry mixture to discharge outlet 16 of the pump 10 at a substantially higher pressure depending on the speed of rotation of the shaft 17.

During this operation the pressure at area D of the discharge outlet 16 will be sensed by the sensing element 83 and simultaneously the pressure at area E of the suction inlet flow passage 20 will be sensed by the sensing element 93.

The pressure sensed by sensing element 83 is transmitted through line 84 to the positioner 82 and the positioner 82 will adjust the control valve 81 so that flushing liquid will be supplied by pump 67a through line 67 to the manifold 66 where it passes through line 62 and 60 to the flushing liquid inlet chamber 46.

From the flushing liquid inlet chamber 46 the flushing liquid passes through the plurality of spaced openings 44 into the leakage space between the wearing ring 35 and the extended portion 22 of the front shroud 21 of impeller 18 where it flows axially in opposite directions, a portion discharging into the area D of the discharge outlet and a portion passing in the direction of the suction inlet flow passage 20.

However by reason of the spaced plurality of openings 45 which lie between the openings 44 and the suction inlet flow passage 20 a further portion of the flushing liquid passing in the direction towards the suction inlet flow passage will be drained through these openings 45 into the flushing liquid outlet chamber 48 where they will be drained or returned through flushing liquid drain conduit 68 and 70 to the flushing liquid outlet manifold 74.

The quantity of flushing liquid passing from the outlet manifolds 74 through line 75 will depend on the pressure setting imposed on the control valve 91 by the positioner 92 which receives its signals from the sensing means 93 and suction inlet pressure transmitting line 94.

By suitably adjusting the pressure settings of the control valve 81 and 91 so as to maintain in both the flushing liquid delivered and the flushing liquid returned some finite pressure in the case of control valve 81 greater than the pressure at point D and for the control valve 91 greater than the pressure at point E, the quantity of flushing liquid delivered to the leakage joint and returned from the leakage joint can be so controlled as to minimize the quantity of flushing liquid which passes to the suction inlet flow passage and the discharge outlet of the pump during the operation thereof.

This will be more readily understood by reference to FIG. 8 where finite conditions of operations are provided to show how the flushing liquid can be proportioned so as to achieve optimum flushing liquid delivery to the wearing ring and at the same time provide minimum dilution of the slurry or like mixture being pumped by the pump 10.

Further in order to demonstrate the performance characteristics of the flushing liquid system in accordance with the present invention a comparison thereof with the prior art is shown at FIGS. 6 and 7 and the respective operating conditions at FIG. 8 of the drawings.

A typical prior art flushing liquid system for the wearing ring in a centrifugal pump is generally designated 120 in FIG. 6 of the drawings and the centrifugal pump as shown in FIG. 7 will be understood to represent the preferred embodiment of the invention as shown in FIGS. 1 to 5 of the drawings and described in detail above.

The prior art flushing liquid system for the pump 120 comprises a wearing ring 122 having a flushing liquid inlet conduit means 124 extending therethrough for supplying flushing liquid from any suitable supply means (not shown) to the liquid joint 126 between the wearing ring 122 and the outer face of the extended portion 127 of the front shroud for the impeller 128.

In this prior art flushing liquid system, the flushing liquid is supplied through conduit means 124 to the point A at the leakage joint 126 and will flow therefrom axially in both directions along the leakage joint to the point D in the discharge outlet in one direction and to the point E in the suction inlet flow passage in the other direction, to flush the leakage joint as clean as possible.

Since this prior art type flushing liquid system makes no provision for drainage of any portion of the flushing liquid supplied to the leakage joint 126, it is elementary to conclude that all of the flushing liquid will be introduced as a diluent to the slurry or like mixture being pumped by such prior art pump.

Now more specifically with reference to the prior art flushing liquid system shown at FIG. 6 and the corresponding column for FIG. 6 in the table at FIG. 8, when the prior art pump 120 is operated to provide a total pump flow Q of 5,000 GPM of slurry at a pressure $P_1$ of 100 PSIG at the area E in the suction inlet flow passage and a pressure $P_3$ of 450 PSIG at the area D in the discharge outlet, a volume of flushing liquid $q_1$ of 215 GPM at an injection pressure of 700 PSIG must be delivered through the inlet conduit 124 to the passage A as this constitutes the volume and pressure of flushing liquid that will be required to insure adequate flushing of the leakage joint under all pump operating conditions.

The pressure $P_3$ will be lower than the discharge pressure $P_2$ because the slurry or other mixture being pumped which is closest to the hub of the impeller is trapped and rotated between the front shrouds on opposite sides of the impeller and the inner wall of the associated casing, while that at the periphery of the impeller is free to pass into the discharge outlet 16.

At these operating conditions with flushing liquid being delivered at the volume and pressures indicated the differential pressure $\Delta P$ and the flow rates which result therefrom will be as tabulated under the FIG. 6 column in FIG. 8.

The total dilution by the flushing liquid of the liquid being pumped in such prior art pump and the illustrated conditions must be 215 GPM as calculated in the comparison chart at FIG. 8 because no portion of the flushing liquid is drained from the system, and this represents a total dilution of 4.3% of the slurry being pumped calculated as follows:

$$\frac{\text{Dilution-215 } GPM}{\text{Total } Q\text{-5,000 } GPM} = .043 \times 100\% = 4.3\%$$

Now making a corresponding analysis by referring to FIG. 7 which shows the pump 10 and the flushing liquid system for wearing rings as above described and the comparison tabulation in the Column corresponding thereto in FIG. 8, we can find a corresponding analysis at the same pumping conditions.

Thus when pump 10 is operated to provide a total pump flow Q of 5,000 GPM of slurry at a pressure $P_1$ of 100 PSIG in the area E of the suction inlet flow passage and a pressure $P_3$ of 450 PSIG at the area D of the discharge outlet when the pressure $P_1$ is transmitted by the sensing means 83 to the positioner 82, the control valve 81 by suitable proportioning means will be set so that the pump **67*a* will deliver through line 67 to the inlet manifold 66 a flow rate $Q_1$ of 137.5 GPM of flushing liquid at an injection pressure of 500 PSIG. Similarly when the pressure $P_1$ is transmitted by the sensing means 93 to the positioner 92 the control valve 91 by suitable proportioning means will bleed off or return the flushing liquid from the flushing liquid outlet chamber 48 through conduits 68, 70 and drain manifold 74 through drain line 75 at a flow rate of $Q_4$ of 6.25 GPM and at a pressure of 150** PSIG.

Under these conditions and ignoring the small pressure drop through the inlet appertures 44 and outlet appertures 45 a differential pressure $\Delta P$ of 50 PSI will exist between point A and point D which will result in a flow of flushing liquid from the flushing liquid inlet chamber to the discharge outlet 16 at a flow rate of $Q_2$ of 37.5 GPM of the flushing liquid which thus insures that entry of the slurry being pumped from the discharge side of the pump into the leakage joint or interface between the wearing ring and the extension 22 of the front shroud 21 of the impeller is substantially prevented.

In the leakage joint flow will also occur in the opposite direction because there will be a differential pressure $\Delta P$ between between the points A and B in the leakage joint of 350 PSI and between the points B and E of 50 PSI.

Between the points A and B, flushing liquid will flow at a rate of 100 GPM. However, the total flow rate will not pass through the openings 45 at B to the flushing liquid return chamber 48 because of the differential pressure which exists between the points B and E as above stated. A portion $Q_4$ or 62.5 GPM will drain off through the outlets 45 to the flushing liquid return chamber 48 where it is passed to drain or return by passages and conduits 68, 70, collecting manifold 74 and an outlet line 75 as above described and the remaining flow of flushing liquid $Q_3$ of 37.5 GPM will flow from the leakage joint into the area E in the suction inlet flow passage for the pump 10 and this will serve to prevent the entry of the slurry or like mixture being pumped from entering into the leakage joint or interface between the wearing ring and the front shroud of the impeller 18 from the suction inlet flow passage 20 of the pump 10.

The overall advantageous result of the above is that the wearing ring and leakage joint are maintained substantially free of the slurry or like mixture being pumped by the constant flushing action as above described of the flushing liquid and abrasion and wear of the wearing ring by such slurry or other mixture is substantially prevented. Of equal significance to meeting the flushing requirements of the wearing ring is the fact that the dilution of the slurry or other mixture being pumped which may be sensitive to such dilution by the flushing liquid is substantially reduced by the carefully controlled draining or bleeding off as above described of a large portion of the flushing liquid without any adverse effect on the required flushing action of the wearing ring and leakage joint.

More specifically in the example illustrated herein of liquid system for wearing rings in accordance with the invention as shown and described, calculations will show that for each wearing ring over 47% or 62.5 GPM of the flushing liquid total delivered flow of 137.5 GPM is bled-off or drained from the pump during operation which results in a reduction of over 47% in the amount of flushing liquid which would otherwise be introduced to the slurry or other mixture being pumped as a diluent if the prior art flushing liquid system was utilized.

In a like manner it may also be readily calculated that at the given example of a 5,000 GPM slurry flow rate through the pump 10, the introduction of only 75 GPM of flushing liquid i.e. $Q_2$ (37.5 GPM at E) + $Q_3$ (37.5 GPM at D) as a diluent to the slurry being pumped represents a mere 1.5% dilution of the slurry per wearing ring and this low 1.5% dilution will immediately be recognized by those skilled in this art as a reduction to about one-third the magnitude when compared to those dilutions provided by the flushing liquid systems for wearing rings in accordance with the prior art.

The reason for this is apparent from the fact that the flushing liquid systems for wearing rings in accordance with the prior art have no control means which are responsive to the operating parameters of the pump and thus as stated above portions of the flushing liquid must be maintained in said prior art systems at relatively high levels at all times to insure adequate flushing of the leakage joint under all pump operating conditions of such prior art pumps.

Calculations will show that over 156% ($Q_1$ of FIG. 6) (215GPM) versus $Q_1$ of FIG. 7 (137.5 GPM) more flushing liquid will be required in the prior art system than in a system in accordance with the present invention.

Operation of the pump 10 at lower flow rates will produce a rise in the pump discharge pressure with a corresponding increase of pressure at the area D in the discharge outlet 16. This increased pressure when transmitted to the control system will result in an even further reduction in the ratio between slurry dilution as provided by the flushing liquid system for wearing rings in accordance with the present invention and those flushing liquid systems for wearing rings as shown by the prior art.

More specifically although the increase in pressure at D will require greater flushing liquid injection pressure for both the flushing liquid systems for wearing rings as shown by the prior art and as shown and described herein, it is only with the flushing liquid systems for wearing rings in accordance with the prior art as is shown at FIG. 6 that this increase in injection pressure will result in increased flushing liquid flow $Q_3$ into the suction side of the pump due to the increase in differential pressure which will occur between the point A where the flushing liquid is introduced and the area E in the suction inlet flow chamber as shown in FIG. 6.

Thus the difference between the dilution flows between the prior art form of the invention shown in FIG. 6 and the form of flushing liquid system for wearing rings shown in FIG. 7 will increase as a function of the lower flow rates being handled by the pumps.

In FIGS. 2, 5 and more particularly in FIG. 9 it will be noted that the inner analysis of the wearing ring 35 has a first set of spiral threads as at 130 adjacent the area D in the discharge outlet 16 which are threaded in a direction so as to oppose entry of the process fluid, slurry or mixture being pumped into the leakage joint between the spiral threads 130 and the extended section 25 of the front shroud 24 of the impeller 18 from the discharge outlet. Similarly at the opposite end of the inner annulus of the wearing ring 35 spiral threads 131 are provided adjacent the area E in the suction inlet flow passage 20. Spiral threads 131 are also threaded in a direction to resist entry of the pumped fluid, slurry or other mixture into the leakage joint between the spiral threads 131 and the extended end 25 of the first shroud 24 of the impeller 18 from the suction inlet flow passage.

Thus, the total head at each end of the wearing ring will be increased by a small quantity and the operation and the efficiency of the flushing liquid system in accordance with the present invention therefore will also be increased.

Although the flushing liquid system for wearing rings in accordance with the present invention has been shown in a preferred embodiment of a double suction centrifugal pump which is used in the pumping of slurries it will be understood by those skilled in the art that the flushing liquid systems for wearing rings and the improved wearing ring and wearing ring assembly in accordance with the present invention are not to be so limited but are suitable for use in a wide variety of other and different types of fluid mixtures.

Further it will be understood that the invention is not to be limited to the specific construction or arrangement of parts shown but that the same may be widely modified without departing from the spirit and scope of the invention as is now defined by the appended claims.

What is claimed is:

1. In a centrifugal pump forming a pumping chamber therein having a suction inlet and a discharge outlet, a support member in said centrifugal pump disposed between said suction inlet and discharge outlet and having a central opening therethrough, impeller means having at least one front shroud means rotatably mounted in said pumping chamber so that the front shroud means extends into said central opening in the support member, and wearing ring assembly means fixedly mounted in fluid tight engagement in said central opening in said support means and disposed about the front shroud means of said impeller means to form a leakage joint therewith, the combination therewith of a flushing liquid system wherein:

a. said wearing ring assembly means has flushing liquid inlet means and flushing liquid outlet means disposed thereon in spaced relation, b. flushing liquid supply means operably connected to said centrifugal pump to supply flushing liquid to said flushing liquid inlet means in the wearing ring assembly means, c. flushing liquid return means operatively connected to said centrifugal pump to drain flushing liquid from said flushing liquid outlet means in said wearing ring assembly means, d. a first control means to control the pressure at which said flushing liquid is supplied by said flushing liquid supply means to said flushing liquid inlet means in said wearing ring assembly means, e. a second control means to control the pressure at which said flushing liquid is drained from said flushing liquid outlet means in the wearing ring assembly means, and f. said first control means and said second control means operative and responsive to at least one operating condition of said pump whereby some portion of the flushing liquid supplied to said wearing ring assembly means through said flushing liquid inlet means will be drained through said flushing liquid outlet means to minimize the flushing liquid requirements of said pump and to reduce dilution by the flushing liquid of the process fluid or other mixture being pumped by the centrifugal pump.

2. In the combination as claimed in claim 1 wherein said wearing ring assembly means includes, a. a wearing ring, b. said wearing ring having a first annular groove on the outer annulus thereof to define at least in part said flushing liquid inlet means, c. means in said wearing ring for connecting said first annular groove with said leakage joint, d. said wearing ring having a second annular groove on the outer annulus thereof spaced axially from said first annular groove and defining at least in part said flushing liquid outlet chamber, and e. second means in said wearing ring connecting said annular groove with said leakage joint.

3. In the combination as claimed in claim 2 wherein said flushing liquid supply means includes, a. flushing liquid supply line means connected to said flushing liquid inlet means, b. means connected to the end of said flushing liquid supply line means remote from the flushing liquid inlet means to supply flushing liquid under pressure through said flusing liquid supply line means, c. said first control means including, a control valve in said flushing liquid supply line means operable to control the pressure under which the flushing liquid is supplied therethrough, d. positioner means operatively connected to said control valve means for adjustably positioning the same, and e. sensing means connected to said positioner means for sensing said pump operating condition and for signalling the same to said positioner means to adjust the control valve in accordance therewith.

4. In the combination as claimed in claim 2 wherein said flushing liquid return means includes, a. flushing liquid return line means connected at one end to said flushing liquid outlet means and extending to the exterior of the pump at the end remote therefrom, b. said second control means including a control valve in said flushing liquid return line means operable to control the pressure under which said flushing liquid is returned therethrough, c. positioner means operatively connected to said control valve for adjustably varying the same, and d. sensing means connected to said positioner means for sensing said pump operating condition and for signalling the same to said positioner means for controlling the pressure of the flushing liquid returned through said flushing liquid return line means.

5. In the combination as claimed in claim 2 wherein, a. said flushing liquid supply means includes, a flushing liquid supply line means connected at one end to said flushing liquid inlet means in the wearing ring, b. means connected to the flushing liquid supply line means at the end remote from the flushing liquid inlet means for supplying the said flushing liquid under pressure therethrough, c. said first control means including a first control valve means in said supply line means operable to control the pressure under which the flushing liquid is supplied therethrough, d. a first positioner means operatively connected to said first control valve means for adjustably positioning the same, and e. a first sensing means connected to said positioner means and to said centrifugal pump for sensing a first pump operating pressure condition and for signalling the same to said positioner for controlling the flushing liquid supply pressure in accordance therewith, f. said flushing liquid return means including, flushing liquid return line means connected at one end to said flushing liquid outlet means and disposed at the end remote therefrom to extend to the exterior of said centrifugal pump, g. said second control means including a second control valve means in said flushing liquid return line means operable to control the pressure under which flushing liquid is returned therethrough, h. a second positioner means operatively connected with said second control valve means for adjustably positioning the same, and i. a second sensing means connected to said positioner means and to said pump for sensing a second pump operating condition and for signalling the same to control the pressure of the flushing liquid passing through said return line means in accordance therewith and, j. said first positioner means and second positioner means operatively associated to each other to control the portion of the flushing liquid drained through said flushing liquid outlet means to said flushing liquid inlet means will be drained through said flushing liquid outlet means during operation of said centrifugal pump.

6. In a centrifugal pump forming a pumping chamber therein having a suction inlet and a discharge outlet, a support member in said centrifugal pump disposed between said suction inlet and discharge outlet and having a central opening therethrough, impeller means having at least one front shroud means rotatably mounted in said pumping chamber so that the front shroud means extends into said central opening in the support member, and wearing ring means fixedly mounted in fluid tight engagement in said central opening in said support means and disposed about the front shroud means of said impeller means to form a leakage joint therewith, the combination with said wearing ring means of a flushing liquid system including:

a. said wearing ring means having flushing liquid inlet means and flushing liquid outlet means disposed thereon in spaced relation, b. flushing liquid supply means operably connected to said centrifugal pump to supply flushing liquid to said flushing liquid inlet means in the wearing ring means, c. flushing liquid return means operatively connected to said centrifugal pump to drain flushing liquid from said flushing liquid outlet means in said wearing ring means, d. a first control means responsive to the pressure at the discharge side of said centrifugal pump to control the pressure at which said flushing liquid is supplied by said flushing liquid inlet means in said wearing ring means, e. a second control means responsive to suction inlet pressure to control the pressure which said flushing liquid is drained from said flushing liquid outlet means in the wearing ring means, and f. said first control means and said second control means operatively related to each other whereby some portion of the flushing liquid supplied to said wearing ring means through said flushing liquid inlet means will be drained through said flushing liquid outlet means to reduce dilution of the fluid being pumped by the centrifugal pump.

7. In a wearing ring assembly means for the flushing liquid system of a centrifugal pump, said centrifugal pump having a support means with a central opening therethrough disposed between the suction inlet and discharge outlet of said centrifugal pump, a. an annular wearing ring member having an outer annulus, and an inner annulus, b. said wearing ring sized and shaped to be removably mounted in the opening in said support member, c. said wearing ring having a first annular groove on the outer annulus thereof for defining a flushing liquid inlet means, d. said wearing ring having a second annular groove on the outer annulus-thereof spaced from said first annular groove for defining a flushing liquid return means therein, e. means on the outer annulus to provide a fluid tight seal between first said annular groove and said second annular groove when the wearing ring is in assembled position, and f. flushing liquid supply means on said centrifugal pump extending through said support means for connection to said first annular groove, and g. flushing liquid return means on said centrifugal pump extending through said support means for communication with said second annular groove means, and h. a first plurality of spaced openings circumferentially disposed on said wearing ring to connect said first annular groove with the inner annulus of said wearing ring, and i. a second plurality of circumferentially spaced openings on said wearing ring for connecting said second annular groove to the inner annulus of said wearing ring.

8. In a wearing ring assembly as claimed in claim 7 wherein said annular wearing ring includes, a. a first plurality of spiral threads on the inner annulus adjacent one end of said wearing ring and having a predetermined direction for the threads to resist movement of process fluids being pumped by said centrifugal pump toward said first annular groove, and b. a second plurality of spiral threads on said inner annulus of the wearing ring at the opposite end of the wearing ring having a predetermined direction of spiral to resist movement of process fluid being pumped by centrifugal pump from the suction inlet.

9. A wearing ring for use in a flushing liquid system for a centrifugal pump comprising:

a. an annular member having an inner annulus and an outer annulus, b. a first groove means formed on the outer annulus of said annular member adapted to define a flushing liquid inlet chamber for the receipt of flushing liquid, c. a second groove means formed in the outer annulus of said annular member, a spaced distance from said first groove means adapted to define a flushing liquid outlet chamber for the discharge of flushing liquid, d. a first means communicating said first groove means with said inner annulus of said annular member, e. a second means for communicating said second groove means with said inner annulus of the annular member, whereby when flushing liquid is supplied to said inner annulus through said first means at least some portion thereof may be returned from said inner annulus through said second means to the flushing liquid outlet chamber formed by said second groove means.

10. In a wearing ring as claimed in claim 9 wherein said first means for communicating said first groove means with said inner annulus comprises a plurality of circumferentially spaced appertures which extend from said first groove means to the inner annulus of the wearing ring, and said second means communicating said second groove means with said inner annulus comprises a second plurality of circumferentially spaced apertures extending from said second groove means to said inner annulus.

11. In a wearing ring as claimed in claim 9 including, a. seal means for establishing a fluid tight connection between said wearing ring and said support member when said wearing ring is in assembled position, and b. said seal means disposed between said first groove means and second groove means for maintaining the same independently and sealed from each other.

* * * * *